US006076792A

United States Patent [19]

Dozeman

[11] Patent Number: 6,076,792

[45] Date of Patent: Jun. 20, 2000

[54] DRINKING VESSEL SYSTEM

[76] Inventor: Natalie A. Dozeman, 4934 Beech Tree St., Hudsonville, Mich. 49426

[21] Appl. No.: 09/243,405

[22] Filed: Feb. 1, 1999

[51] Int. Cl.[7] ..... A47K 1/09

[52] U.S. Cl. ..... 248/311.2; 224/400; 220/694

[58] Field of Search ..... 248/311.2, 214, 248/230.7, 146, 231.71, 231.81, 230.6; 220/475, 288, 710.5, 743; 224/414, 420, 448, 459; 403/119, 161, 374.3

[56] References Cited

U.S. PATENT DOCUMENTS 4,596,370 6/1986 Adkins ..... 248/311.2
4,711,365 12/1987 Fomby ..... 220/288
5,356,107 10/1994 Sinohuiz ..... 248/311.2
5,503,297 4/1996 Frankel ..... 248/311.2 X
5,597,148 1/1997 Gospodarich ..... 248/311.2

*Primary Examiner*—Leslie A. Braun
*Assistant Examiner*—A. Joseph Wujciak
*Attorney, Agent, or Firm*—Joseph N. Breaux

[57] ABSTRACT

A drinking vessel system that includes an insulated beverage cup that is fillable with a desirable beverage, sealable and then attachable to the handle of a lawnmower before mowing begins so that the beverage is readily available when break time arrives. The drinking vessel system includes an insulated beverage cup assembly, a permanent attachment block assembly, and a combined clamping and beverage cup securing assembly.

1 Claim, 3 Drawing Sheets

DRINKING VESSEL SYSTEM

TECHNICAL FIELD

The present invention relates to anti-spill drink holders and more particularly to a drinking vessel system including an insulated beverage cup assembly, a permanent attachment block assembly, and a combined clamping and beverage cup securing assembly; the beverage cup assembly including an insulated cup portion and an insulated sealing cap; the insulated cup portion having a sidewall partially forming a beverage containment cavity and a handle extending from the exterior of the sidewall, a threaded drinking opening in connection with the beverage containment cavity and a hollow pivot pin tube formed across the beverage containment cavity adjacent to the drinking opening and in connection with two openings formed through the sidewall of the lower insulated cup portion; the insulated sealing cap having a threaded bottom portion for threadably engaging and sealing the threaded drinking opening of the insulated cup portion; the permanent attachment block assembly including two hingedly connected block members having grooved outer surfaces and inner facing surfaces that each have semi-circular cross section channels formed therein that are aligned in registration when the two block members are positioned into the closed position and form a handlebar receiving passageway for the handlebar of a lawn mower, snow blower or other like equipment having a handlebar prior to permanently adhesively securing the block members together and to the handlebar during installation of the permanent attachment block assembly; the combined clamping and beverage cup securing assembly including a clamping block having a attachment block receiving channel keyed to engage and hold the grooved outer surfaces of the attachment block assembly and a set screw that is screwable against the side of the attachment block to hold it in fixed relationship with the clamping block, a first L-shaped upright member extending from the clamping block and terminating in a first pivot pin securing structure including a pivot pin end receiving cavity, a second L-shaped upright member extending from the clamping block with a longer side in parallel orientation with the longer side of the first L-shaped upright member and terminating in a second pivot pin securing structure including a pivot pin securing structure passageway and a pivot pin securing catch passageway, and a securing pin having an elongated portion and a flexible securing catch structure, the elongated portion being sized such that when the elongated portion is positioned through the securing structure pivot pin passageway, through the hollow pivot pin tube and the pivot pin end is seated within pivot pin end receiving cavity of the first pivot pin securing structure the flexible securing catch structure is in locking engagement with the pivot pin securing catch passageway of the second pivot pin securing structure.

BACKGROUND ART

After and while mowing the lawn or performing other activities with wheeled equipment having a handlebar it can be desirable to take a break and enjoy a cold or hot beverage. Although such beverages can be desirable, it can often be a long walk back home to get the beverage or difficult to clean up sufficiently to enter the home to retrieve the beverage. It would be a benefit, therefore, to have a drinking vessel system that included an insulated beverage cup that could be filled with a desirable beverage, sealed and then attached to the lawnmower before mowing begins so that the beverage is readily available when break time arrives.

GENERAL SUMMARY DISCUSSION OF INVENTION

It is thus an object of the invention to provide a drinking vessel system that includes an insulated beverage cup that is fillable with a desirable beverage, sealable and then attachable to the handle of a lawnmower before mowing begins so that the beverage is readily available when break time arrives.

It is a further object of the invention to provide a drinking vessel system that includes an insulated beverage cup assembly, a permanent attachment block assembly, and a combined clamping and beverage cup securing assembly; the beverage cup assembly including an insulated cup portion and an insulated sealing cap; the insulated cup portion having a sidewall partially forming a beverage containment cavity and a handle extending from the exterior of the sidewall, a threaded drinking opening in connection with the beverage containment cavity and a hollow pivot pin tube formed across the beverage containment cavity adjacent to the drinking opening and in connection with two openings formed through the sidewall of the lower insulated cup portion; the insulated sealing cap having a threaded bottom portion for threadably engaging and sealing the threaded drinking opening of the insulated cup portion; the permanent attachment block assembly including two hingedly connected block members having grooved outer surfaces and inner facing surfaces that each have semi-circular cross section channels formed therein that are aligned in registration when the two block members are positioned into the closed position and form a handlebar receiving passageway for the handlebar of a lawn mower or the like prior to permanently adhesively securing the block members together and to the handlebar during installation of the permanent attachment block assembly; the combined clamping and beverage cup securing assembly including a clamping block having a attachment block receiving channel keyed to engage and hold the grooved outer surfaces of the attachment block assembly and a set screw that is screwable against the side of the attachment block to hold it in fixed relationship with the clamping block, a first L-shaped upright member extending from the clamping block and terminating in a first pivot pin securing structure including a pivot pin end receiving cavity, a second L-shaped upright member extending from the clamping block with a longer side in parallel orientation with the longer side of the first L-shaped upright member and terminating in a second pivot pin securing structure including a pivot pin securing structure passageway and a pivot pin securing catch passageway, and a securing pin having an elongated portion and a flexible securing catch structure, the elongated portion being sized such that when the elongated portion is positioned through the securing structure pivot pin passageway, through the hollow pivot pin tube and the pivot pin end is seated within pivot pin end receiving cavity of the first pivot pin securing structure the flexible securing catch structure is in locking engagement with the pivot pin securing catch passageway of the second pivot pin securing structure.

It is a still further object of the invention to provide a drinking vessel system that accomplishes all of the above objects in combination.

Accordingly, a drinking vessel system is provided. The drinking vessel system includes an insulated beverage cup assembly, a permanent attachment block assembly, and a combined clamping and beverage cup securing assembly; the beverage cup assembly including an insulated cup portion and an insulated sealing cap; the insulated cup portion having a sidewall partially forming a beverage containment cavity and a handle extending from the exterior of the sidewall, a threaded drinking opening in connection with the beverage containment cavity and a hollow pivot pin tube formed across the beverage containment cavity adjacent to the drinking opening and in connection with two openings formed through the sidewall of the lower insulated cup portion; the insulated sealing cap having a threaded bottom portion for threadably engaging and sealing the threaded drinking opening of the insulated cup portion; the permanent attachment block assembly including two hingedly connected block members having grooved outer surfaces and inner facing surfaces that each have semi-circular cross section channels formed therein that are aligned in registration when the two block members are positioned into the closed position and form a handlebar receiving passageway for the handlebar of a lawn mower or the like prior to permanently adhesively securing the block members together and to the handlebar during installation of the permanent attachment block assembly; the combined clamping and beverage cup securing assembly including a clamping block having a attachment block receiving channel keyed to engage and hold the grooved outer surfaces of the attachment block assembly and a set screw that is screwable against the side of the attachment block to hold it in fixed relationship with the clamping block, a first L-shaped upright member extending from the clamping block and terminating in a first pivot pin securing structure including a pivot pin end receiving cavity, a second L-shaped upright member extending from the clamping block with a longer side in parallel orientation with the longer side of the first L-shaped upright member and terminating in a second pivot pin securing structure including a pivot pin securing structure passageway and a pivot pin securing catch passageway, and a securing pin having an elongated portion and a flexible securing catch structure, the elongated portion being sized such that when the elongated portion is positioned through the securing structure pivot pin passageway, through the hollow pivot pin tube and the pivot pin end is seated within pivot pin end receiving cavity of the first pivot pin securing structure the flexible securing catch structure is in locking engagement with the pivot pin securing catch passageway of the second pivot pin securing structure.

BRIEF DESCRIPTION OF DRAWINGS

For a further understanding of the nature and objects of the present invention, reference should be had to the following detailed description, taken in conjunction with the accompanying drawings, in which like elements are given the same or analogous reference numbers and wherein.

EXEMPLARY MODE FOR CARRYING OUT THE INVENTION

Figure 1:
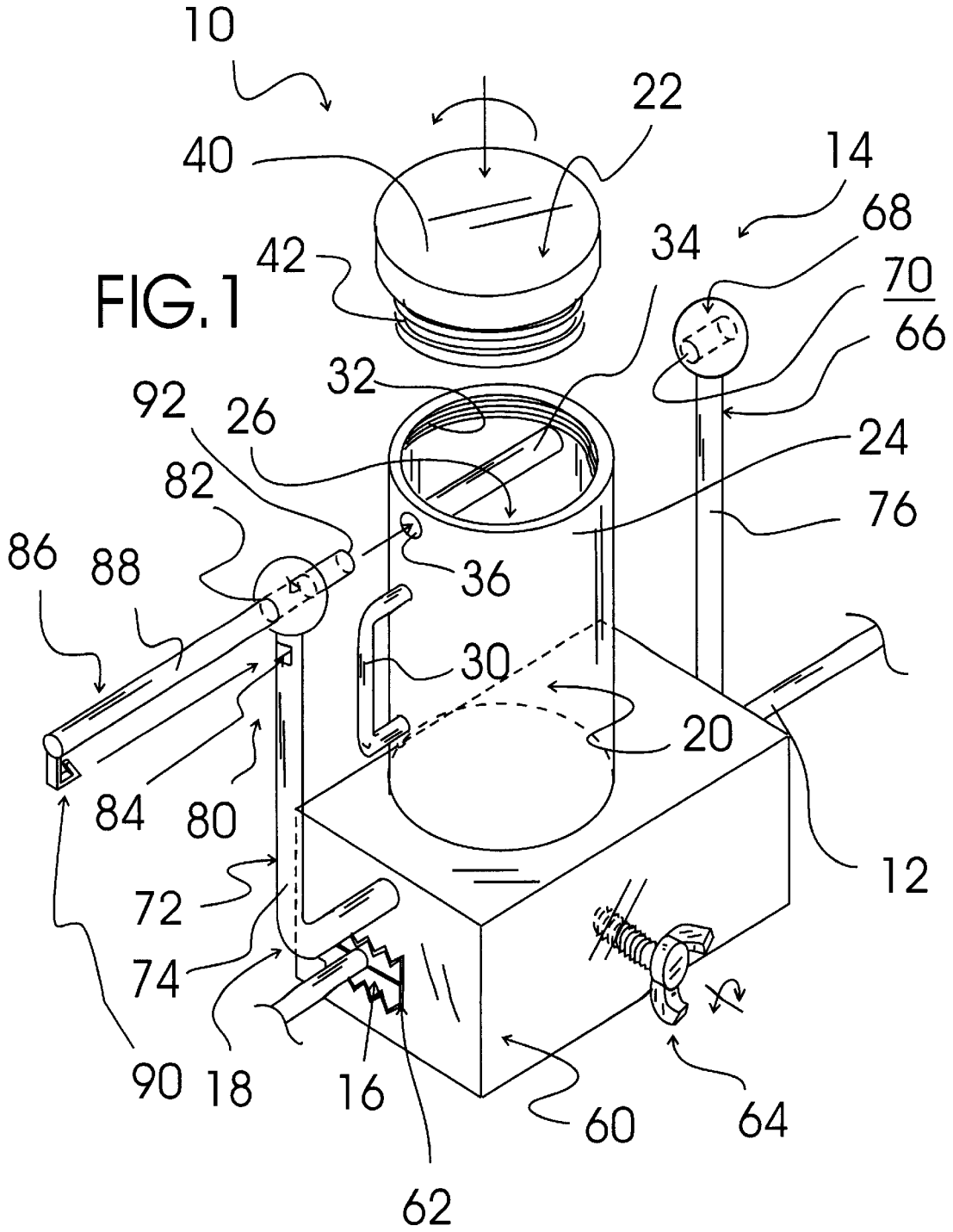
FIG. 1 is a partially exploded perspective view of an exemplary embodiment of the drinking vessel system of the present invention installed onto the push bar of a representative lawn mower, the drinking vessel system including an insulated beverage cup assembly, a permanent attachment block assembly, and a combined clamping and beverage cup securing assembly; the beverage cup assembly including an insulated cup portion and an insulated sealing cap; the insulated cup portion having a sidewall partially forming a beverage containment cavity and a handle extending from the exterior of the sidewall, a threaded drinking opening in connection with the beverage containment cavity and a hollow pivot pin tube formed across the beverage containment cavity adjacent to the drinking opening and in connection with two openings formed through the sidewall of the lower insulated cup portion; the insulated sealing cap having a threaded bottom portion for threadably engaging and sealing the threaded drinking opening of the insulated cup portion; the permanent attachment block assembly including two hingedly connected block members having grooved outer surfaces and inner facing surfaces that each have semi-circular cross section channels formed therein that are aligned in registration when the two block members are positioned into the closed position and form a handlebar receiving passageway for the handlebar of a lawn mower or the like prior to permanently adhesively securing the block members together and to the handlebar during installation of the permanent attachment block assembly; the combined clamping and beverage cup securing assembly including a clamping block having a attachment block receiving channel keyed to engage and hold the grooved outer surfaces of the attachment block assembly and a set screw that is screwable against the side of the attachment block to hold it in fixed relationship with the clamping block, a first L-shaped upright member extending from the clamping block and terminating in a first pivot pin securing structure including a pivot pin end receiving cavity, a second L-shaped upright member extending from the clamping block with a longer side in parallel orientation with the longer side of the first L-shaped upright member and terminating in a second pivot pin securing structure including a pivot pin securing structure passageway and a pivot pin securing catch passageway, and a securing pin having an elongated portion and a flexible securing catch structure, the elongated portion being sized such that when the elongated portion is positioned through the securing structure pivot pin passageway, through the hollow pivot pin tube and the pivot pin end is seated within pivot pin end receiving cavity of the first pivot pin securing structure the flexible securing catch structure is in locking engagement with the pivot pin securing catch passageway of the second pivot pin securing structure.

FIG. 1 shows a partially exploded view of an exemplary embodiment of the drinking vessel system of the present invention, generally designated 10, installed onto a handle push bar 12 of a representative lawn mower. Drinking vessel system 10 includes an insulated beverage cup assembly, generally designated 14; a permanent attachment block assembly, generally designated 16; and a combined clamping and beverage cup securing assembly, generally designated 18. Beverage cup assembly 14 includes an insulated cup portion, generally designated 20, and an insulated sealing cap, generally designated 22. Insulated cup portion 20 is of molded insulating plastic construction and has a sidewall 24 partially forming a beverage containment cavity 26 therein and a handle 30 extending from the exterior of sidewall 24, a threaded drinking opening 32 in connection with beverage containment cavity 26 and a hollow pivot pin tube 34 formed across beverage containment cavity 26 adjacent to drinking opening 32 and in connection with two openings 36 (only one shown) formed through opposite sides of sidewall 24 of lower insulated cup portion 20. Insulated sealing cap 22 is constructed of insulating plastic and has a top portion 40 and a threaded bottom portion 42. Threaded bottom portion 42 threadably engages and seals threaded drinking opening 32 of insulated cup portion 20.

Figure 2:
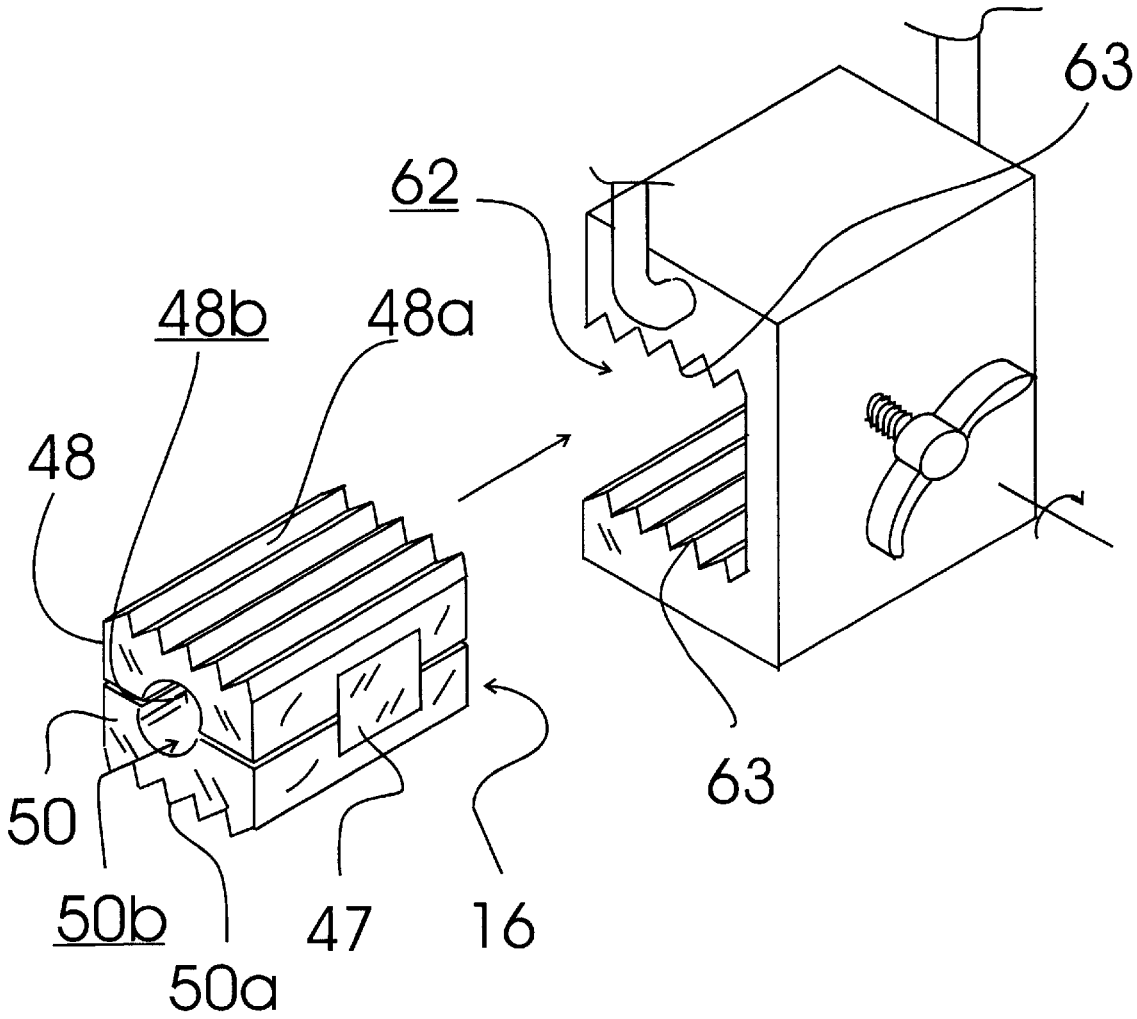
FIG. 2 is a partial perspective view showing the two hingedly connected block members of the permanent attachment block assembly secured in the closed position and aligned with the attachment block receiving channel of the clamping block of the combined clamping and beverage cup securing assembly.

With reference now to FIG. 2, permanent attachment block assembly 16 is of molded metal construction and includes two hingedly connected block members 48,50 having grooved outer surfaces 48*a*,50*a* and inner facing surfaces that each have semi- circular cross section channels 48*b*,50*b* formed therein that are hingedly connected with a flexible hinge structure 47 and aligned in registration when the two block members 48,50 are positioned into the closed position and together form a handlebar receiving passageway for receiving and gripping the handlebar 12 (FIG. 1) of a lawn mower or the like prior to permanently adhesively securing the block members 48,50 together and to handlebar 12 (FIG. 1) during installation of permanent attachment block assembly 16.

Figure 3:
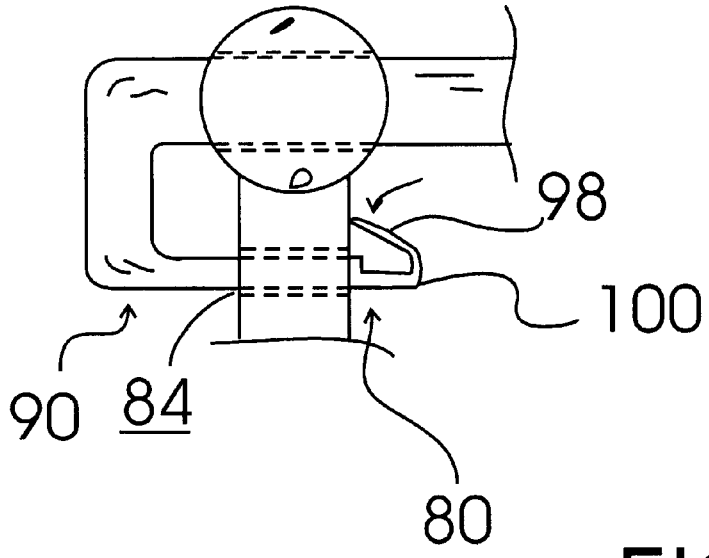
FIG. 3 is partial side plan view showing the flexible locking tab of the flexible securing catch structure positioned through the pivot pin securing catch passageway and in locking engagement with the second pivot pin securing structure.

Referring back to FIG. 1, combined clamping and beverage cup securing assembly 18 includes a clamping block, generally designated 60; a first L-shaped upright member, generally designated 66; a second L-shaped upright member, generally designated 72; and a securing pin, generally designated 86. Clamping block 60 has an attachment block receiving channel 62 (see also FIG. 2) that is keyed 63 to engage and hold the grooved outer surfaces 48*a*,50*a* (FIG. 2) of attachment block assembly 16. A set screw 64 is provided that is screwable through clamping block 60 into contact with the side of attachment block assembly 16 to hold it in fixed relationship with clamping block 60. First L-shaped upright member 66 extends from clamping block 60 and terminates in a first pivot pin securing structure, generally designated 68 that has a pivot pin end receiving cavity 70 formed therein. Second L-shaped upright member 72 extends from clamping block 60 and has a longer side 74 in parallel orientation with a longer side 76 of first L-shaped upright member 66. Second L-shaped upright member 72 terminates in a second pivot pin securing structure, generally designated 80, that includes a pivot pin securing structure passageway 82 and a pivot pin securing catch passageway 84. Securing pin 86 has an elongated portion 88 and a flexible securing catch structure, generally designated 90. Elongated portion 88 is sized such that when elongated portion 88 is positioned through securing structure pivot pin passageway 82, through hollow pivot pin tube 36 and a pivot pin end 92 is seated within pivot pin end receiving cavity 70 of first pivot pin securing structure 68, flexible securing catch structure 90 is in locking engagement with pivot pin securing catch passageway 84 of second pivot pin securing structure 80. Referring now to FIG. 3, flexible securing catch structure 90 includes a flexible locking tab 98 that flexes flat to allow a tip end 100 of flexible securing catch structure 90 to be inserted through pivot pin securing catch passageway 84 of second pivot pin securing structure 80 and then flexes outward to prevent removal of tip end 100. Tip end 100 is released by simultaneously squeezing flexible locking tab 98 downward while pulling on flexible securing catch 90.

Figure 4:
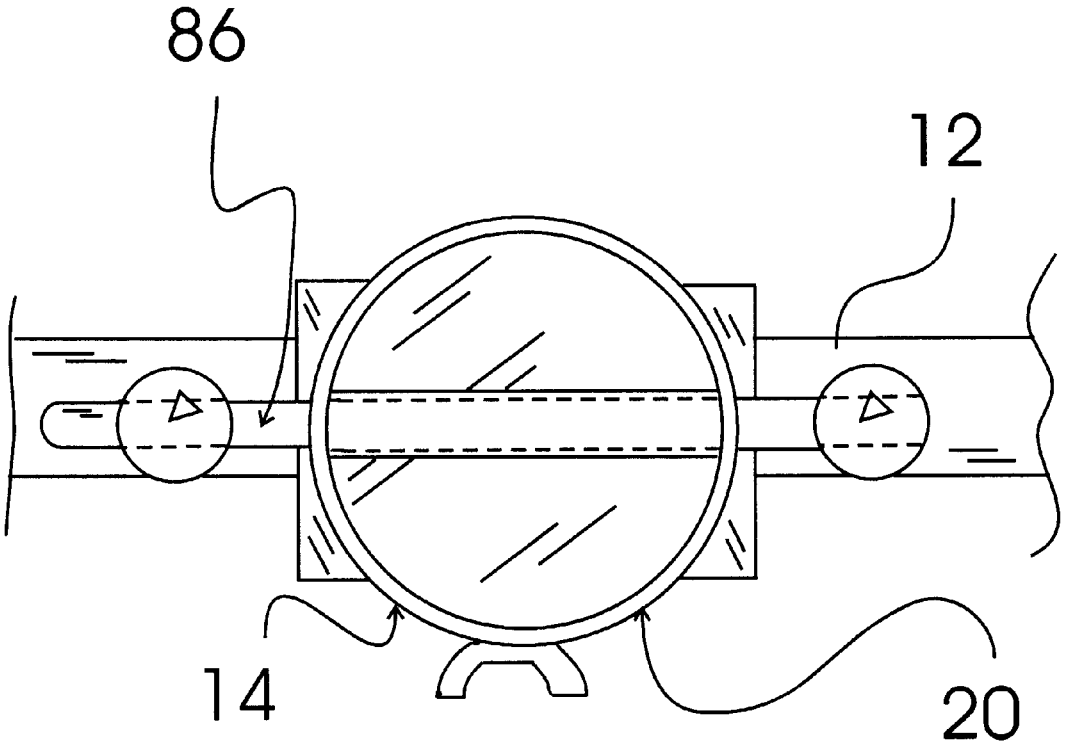
FIG. 4 is a partial top plan view showing the insulated cup portion pivotally suspended between the first and second pivot pin securing structures with the securing pin.

With reference now to FIG. 4, with securing pin 86 thus installed, insulated cup portion 20 is pivotally connected to lawn mower handle push bar 12 and can be easily detached, as described herein above, when it is desired to drink the contents of insulated beverage cup assembly 14 (see also FIG. 1).

It can be seen from the preceding description that a drinking vessel system has been provided that includes an insulated beverage cup that is fillable with a desirable beverage, sealable and then attachable to the lawnmower before mowing begins so that the beverage is readily available when break time arrives; and that includes an insulated beverage cup assembly, a permanent attachment block assembly, and a combined clamping and beverage cup securing assembly; the beverage cup assembly including an insulated cup portion and an insulated sealing cap; the insulated cup portion having a sidewall partially forming a beverage containment cavity and a handle extending from the exterior of the sidewall, a threaded drinking opening in connection with the beverage containment cavity and a hollow pivot pin tube formed across the beverage containment cavity adjacent to the drinking opening and in connection with two openings formed through the sidewall of the lower insulated cup portion; the insulated sealing cap having a threaded bottom portion for threadably engaging and sealing the threaded drinking opening of the insulated cup portion; the permanent attachment block assembly including two hingedly connected block members having grooved outer surfaces and inner facing surfaces that each have semi-circular cross section channels formed therein that are aligned in registration when the two block members are positioned into the closed position and form a handlebar receiving passageway for the handlebar of a lawn mower or the like prior to permanently adhesively securing the block members together and to the handlebar during installation of the permanent attachment block assembly; the combined clamping and beverage cup securing assembly including a clamping block having a attachment block receiving channel keyed to engage and hold the grooved outer surfaces of the attachment block assembly and a set screw that is screwable against the side of the attachment block to hold it in fixed relationship with the clamping block, a first L-shaped upright member extending from the clamping block and terminating in a first pivot pin securing structure including a pivot pin end receiving cavity, a second L-shaped upright member extending from the clamping block with a longer side in parallel orientation with the longer side of the first L-shaped upright member and terminating in a second pivot pin securing structure including a pivot pin securing structure passageway and a pivot pin securing catch passageway, and a securing pin having an elongated portion and a flexible securing catch structure, the elongated portion being sized such that when the elongated portion is positioned through the securing structure pivot pin passageway, through the hollow pivot pin tube and the pivot pin end is seated within pivot pin end receiving cavity of the first pivot pin securing structure the flexible securing catch structure is in locking engagement with the pivot pin securing catch passageway of the second pivot pin securing structure.

It is noted that the embodiment of the drinking vessel system described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. A drinking vessel system comprising:

an insulated beverage cup assembly;

a permanent attachment block assembly; and a combined clamping and beverage cup securing assembly;

said beverage cup assembly including an insulated cup portion and an insulated sealing cap;

said insulated cup portion having a sidewall forming a beverage containment cavity and a handle extending from said exterior of said sidewall, a threaded drinking opening in connection with said beverage containment cavity and a hollow pivot pin tube formed across said beverage containment cavity adjacent to said drinking opening and in connection with two openings formed through said sidewall of said insulated cup portion;

said insulated sealing cap having a threaded bottom portion for threadably engaging and sealing said threaded drinking opening of said insulated cup portion;

said permanent attachment block assembly including two hingedly connected block members having grooved outer surfaces and inner facing surfaces that each have semi-circular cross section channels formed therein that are aligned in registration when said two block members are positioned into said closed position and form a handlebar receiving passageway for said handlebar of prior to permanently adhesively securing said block members together and to said handlebar during installation of said permanent attachment block assembly;

said combined clamping and beverage cup securing assembly including a clamping block having an attachment block receiving channel keyed to engage and hold said grooved outer surfaces of said attachment block assembly and a set screw that is screwable against said side of said attachment block to hold it in fixed relationship with said clamping block, a first L-shaped upright member extending from said clamping block and terminating in a first pivot pin securing structure including a pivot pin end receiving cavity, a second L-shaped upright member extending from said clamping block with a longer side in parallel orientation with said longer side of said first L-shaped upright member and terminating in a second pivot pin securing structure including a pivot pin securing structure passageway and a pivot pin securing catch passageway, and a securing pin having an elongated portion and a flexible securing catch structure, said elongated portion being sized such that when said elongated portion is positioned through said securing structure pivot pin passageway, through the hollow pivot pin tube and said pivot pin end is seated within said pivot pin end receiving cavity of said first pivot pin securing structure said flexible securing catch structure is in locking engagement with said pivot pin securing catch passageway of said second pivot pin securing structure.

* * * * *